US012751506B2

(12) United States Patent
Norris, Jr. et al.

(10) Patent No.: US 12,751,506 B2
(45) **Date of Patent: *Oct. 6, 2026**

(54) WADERS FOR MODERN ADVENTURERS

(71) Applicant: Chene IP, LLC, Memphis, TN (US)

(72) Inventors: Mark Saalfield Norris, Jr., Collierville, TN (US); John Strange, Memphis, TN (US)

(73) Assignee: Chene IP, LLC, Memphis, TN (US)

( * ) Notice: Subject to any disclaimer, the term of this patent is extended or adjusted under 35 U.S.C. 154(b) by 0 days.

This patent is subject to a terminal disclaimer.

(21) Appl. No.: 19/080,153

(22) Filed: Mar. 14, 2025

(65) Prior Publication Data

US 2025/0234941 A1 Jul. 24, 2025

Related U.S. Application Data

(63) Continuation of application No. 17/752,841, filed on May 24, 2022, now Pat. No. 12,250,977.

(51) Int. Cl.

| | |
|---|---|
| ***A41D 13/00*** | (2006.01) |
| ***A41D 13/012*** | (2006.01) |
| ***A41D 13/02*** | (2006.01) |
| ***A41D 27/20*** | (2006.01) |

(52) U.S. Cl.
CPC ..... *A41D 13/012* (2013.01); *A41D 13/02* (2013.01); *A41D 27/201* (2013.01)

(58) Field of Classification Search
CPC ..... A41D 13/012; A41D 13/02; A41D 27/201
See application file for complete search history.

(56) References Cited

U.S. PATENT DOCUMENTS

| | | | | |
|---|---|---|---|---|
| 1,926,866 A | | 9/1933 | Doniger | |
| 2,078,461 A | * | 4/1937 | Siegel | A41D 27/201 2/93 |
| 2,211,550 A | | 8/1940 | Tworoger | |
| 2,224,734 A | | 12/1940 | Kopf | |
| 2,678,447 A | * | 5/1954 | Bracken | A41D 13/0012 2/94 |
| 2,882,532 A | * | 4/1959 | O'Donnell | A41D 27/20 2/253 |
| 4,308,622 A | | 1/1982 | Maddron | |
| 4,791,681 A | | 12/1988 | Dean | |

(Continued)

FOREIGN PATENT DOCUMENTS

JP 2008006118 1/2008

*Primary Examiner* — Richale L Quinn
(74) *Attorney, Agent, or Firm* — MacMillan, Sobanski & Todd, LLC

(57) ABSTRACT

A wader has a body having a chest portion and a lower portion including two leg portions and two boots. The chest portion has first, second, third, and fourth outer pockets. Each of the first and fourth outer pockets has an opening on a side of the wader, while each of the second and third outer pockets has an opening near a midline of the wader. The chest portion has first and second interior pockets, each of which has an opening on an upper side of the pocket. The first interior pocket is adjacent the first outer pocket and inward of the first and second outer pockets; the second interior pocket is adjacent the fourth outer pocket and inward of the third and fourth outer pockets. The first interior pocket is shallower than the second outer pocket and the second interior pocket is shallower than the fourth outer pocket.

15 Claims, 8 Drawing Sheets

(56) References Cited

U.S. PATENT DOCUMENTS 4,858,342 A 8/1989 Nicholson et al.
4,876,724 A 10/1989 Suzuki
5,022,096 A * 6/1991 Pacanowsky ..... A41D 13/012 2/82
5,072,456 A * 12/1991 Elin ..... A41D 13/0012 2/253
5,075,900 A 12/1991 Chittenden
5,081,718 A 1/1992 Carman et al.
5,278,998 A 1/1994 Book
5,509,147 A * 4/1996 Busquets ..... A41D 27/202 2/253
5,829,059 A 11/1998 Covington, Jr.
5,867,828 A 2/1999 Shih
5,878,441 A 3/1999 Busker et al.
6,167,571 B1 * 1/2001 Cheng ..... A41D 13/02 2/87
6,237,152 B1 5/2001 Gootrad
6,772,440 B1 * 8/2004 Foster ..... A41D 13/02 2/82
7,216,370 B1 * 5/2007 Warner ..... A41D 13/0575 2/24
7,225,470 B1 * 6/2007 Bradford ..... A41D 13/0005 2/2.11
7,770,235 B2 8/2010 Lepage et al.
7,810,170 B1 10/2010 Guthrie
8,402,562 B1 * 3/2013 Seddiki ..... A41D 27/205 2/247
8,566,963 B2 10/2013 Ryan
9,066,547 B2 * 6/2015 Kim ..... A41D 27/20
9,532,609 B2 1/2017 Stevenson et al.
10,842,203 B2 11/2020 Wood et al.
11,026,457 B1 * 6/2021 Mayer ..... A41D 27/201
11,140,931 B1 * 10/2021 Stewart ..... A41D 13/0007
11,330,854 B2 5/2022 Abukashef
11,785,997 B1 10/2023 Hadfield
11,849,781 B1 * 12/2023 Merrill ..... A41D 1/06
12,250,977 B2 * 3/2025 Norris, Jr. ..... A41D 13/012
2002/0189000 A1 * 12/2002 Jordan ..... A41D 27/205 2/102
2004/0158910 A1 8/2004 Bay
2004/0221360 A1 * 11/2004 Wood ..... A41D 13/012 2/69
2008/0301861 A1 * 12/2008 Meistrell ..... B63C 9/087 441/103
2009/0282602 A1 * 11/2009 Lepage ..... B29C 66/03242 2/82
2010/0031415 A1 * 2/2010 Shadid ..... A41D 13/01 2/87
2010/0205717 A1 8/2010 McClintock
2010/0306897 A1 * 12/2010 Wood ..... A41F 15/002 2/82
2011/0000944 A1 1/2011 Hood
2011/0057127 A1 3/2011 Slinkard et al.
2011/0067159 A1 3/2011 Smith
2011/0307993 A1 12/2011 McAfee
2013/0152269 A1 6/2013 Coward
2013/0205465 A1 * 8/2013 McClintock ..... A41D 13/02 2/82
2013/0247267 A1 * 9/2013 Luomala ..... A41D 13/012 2/2.17
2015/0060430 A1 3/2015 Tsuge et al.
2015/0181960 A1 7/2015 Goeglein
2015/0342272 A1 12/2015 Bonime et al.
2015/0359269 A1 12/2015 Rapp
2015/0359279 A1 * 12/2015 Chang ..... A41D 13/0012 2/252
2016/0235146 A1 8/2016 Kim
2016/0295930 A1 10/2016 Stevenson et al.
2016/0360804 A1 12/2016 Beltramo et al.
2017/0020215 A1 1/2017 Merritt
2017/0095022 A1 4/2017 Hollimon et al.
2017/0156415 A1 6/2017 Winner
2017/0208875 A1 * 7/2017 Shih ..... A41D 31/102
2017/0245567 A1 8/2017 Fathollahi et al.
2018/0064181 A1 3/2018 Skurla
2018/0153230 A1 * 6/2018 Verner ..... A41D 27/20
2018/0199646 A1 * 7/2018 Myers ..... A41D 27/208
2018/0222559 A1 8/2018 Beyeler
2019/0098948 A1 * 4/2019 Studinger ..... A41D 1/02
2019/0104775 A1 * 4/2019 Wood ..... A41D 3/00
2020/0121000 A1 * 4/2020 Wood ..... A41D 13/012
2020/0146368 A1 5/2020 Skurla
2020/0196691 A1 6/2020 Abukashef
2021/0030080 A1 2/2021 Lee
2021/0161222 A1 * 6/2021 Krull ..... A41D 31/102
2021/0196007 A1 7/2021 Haugen
2021/0196009 A1 7/2021 Haugen
2021/0267291 A1 9/2021 Mayer
2022/0304401 A1 * 9/2022 Nelson ..... A41D 31/102
2022/0338573 A1 10/2022 Millsap
2022/0361607 A1 11/2022 Jusic
2023/0083573 A1 * 3/2023 Rogers ..... A41D 3/00 2/247
2023/0119312 A1 * 4/2023 Norris, Jr. ..... A41D 27/201 2/79
2023/0380521 A1 11/2023 Park et al.
2023/0397675 A1 12/2023 Meyers
2024/0016241 A1 1/2024 Massey et al.

* cited by examiner

WADERS FOR MODERN ADVENTURERS

FIELD

The disclosure relates to the field of adventure gear. More particularly, the disclosure relates to waders useful in hunting and fishing. Specific examples relate to waders with improved pocket configurations and other features.

BACKGROUND

Waders are an important article of gear for hunters, fishers, and others seeking adventure in wet environments. Waders have long provided protection from water while allowing freedom of movement, enabling pursuit of fin and fowl in areas otherwise unwelcoming of such activity.

Hunting, fishing, and other adventure activities have grown dramatically in recent years, which has brought change to the sports. For example, in addition to traditional equipment, modern duck hunters frequently carry, and need ready access to, mobile computing devices, such as a smartphone, to document and share images and video of their adventures. Unfortunately, the technology underlying conventional gear, including the wader, has not sufficiently responded to these changes and, as a result, stands as an impediment to these new dimensions of these sports.

A need exists, therefore, for improved waders.

SUMMARY OF SELECTED EXAMPLES

Various waders are described herein.

An example wader comprises a body having a chest portion, a lower portion including first and second leg portions, a first boot attached to the first leg portion and a second boot attached to the second leg portion, the body having an outer surface, an inner surface, and defining an inner chamber sized and configured to receive the legs and torso of a wearer of said wader; the chest portion having first, second, third, and fourth outer pockets, each of the first, second, third, and fourth outer pockets having opening on the outer surface, each of the first and fourth outer pockets having an opening placed on a side of said wader, each of the second and third outer pockets having an opening placed near a midline of said wader; and the chest portion having first and second interior pockets disposed on the inner surface, each of the first and second interior pockets having an opening on an upper side of the pocket, the first interior pocket disposed adjacent the first outer pocket and inward of the first and second outer pockets, and the second interior pocket disposed adjacent the fourth outer pocket and inward of the third and fourth outer pockets.

Another example wader comprises a body having a chest portion, a lower portion including first and second leg portions, a first boot attached to the first leg portion and a second boot attached to the second leg portion, the body having an outer surface, an inner surface, and defining an inner chamber sized and configured to receive the legs and torso of a wearer of said wader; the chest portion having first, second, third, and fourth outer pockets, each of the first, second, third, and fourth outer pockets having opening on the outer surface, each of the first and fourth outer pockets having an opening placed on a side of said wader, each of the second and third outer pockets having an opening placed near a midline of said wader; and the chest portion having first and second interior pockets disposed on the inner surface, each of the first and second interior pockets having an opening on an upper side of the pocket, the first interior pocket disposed adjacent the first outer pocket and inward of the first and second outer pockets, and the second interior pocket disposed adjacent the fourth outer pocket and inward of the third and fourth outer pockets. The first interior pocket has a first depth and the second outer pocket has a second depth. The first depth is less than the second depth.

Another example wader comprises a body having a chest portion, a lower portion including first and second leg portions, a first boot attached to the first leg portion and a second boot attached to the second leg portion, the body having an outer surface, an inner surface, and defining an inner chamber sized and configured to receive the legs and torso of a wearer of said wader; the chest portion having first, second, third, and fourth outer pockets, each of the first, second, third, and fourth outer pockets having opening on the outer surface, each of the first and fourth outer pockets having an opening placed on a side of said wader, each of the second and third outer pockets having an opening placed near a midline of said wader; and the chest portion having first and second interior pockets disposed on the inner surface, each of the first and second interior pockets having an opening on an upper side of the pocket, the first interior pocket disposed adjacent the first outer pocket and inward of the first and second outer pockets, and the second interior pocket disposed adjacent the fourth outer pocket and inward of the third and fourth outer pockets. The first interior pocket has a first depth and the second outer pocket has a second depth. The first depth is less than the second depth. The second interior pocket has a third depth and the fourth outer pocket has a fourth depth. The third depth is less than the fourth depth.

Another example wader comprises a body having a chest portion, a lower portion including first and second leg portions, a first boot attached to the first leg portion and a second boot attached to the second leg portion, the body having an outer surface, an inner surface, and defining an inner chamber sized and configured to receive the legs and torso of a wearer of said wader; the chest portion having first, second, third, and fourth outer pockets, each of the first, second, third, and fourth outer pockets having opening on the outer surface, each of the first and fourth outer pockets having an opening placed on a side of said wader, each of the second and third outer pockets having an opening placed near a midline of said wader; and the chest portion having first and second interior pockets disposed on the inner surface, each of the first and second interior pockets having an opening on an upper side of the pocket, the first interior pocket disposed adjacent the first outer pocket and inward of the first and second outer pockets, and the second interior pocket disposed adjacent the fourth outer pocket and inward of the third and fourth outer pockets. The first leg portion includes a first circumferential seal attaching the first leg portion to the first boot and a first leg extension extending from the first circumferential seal to a first terminal end of the first leg portion. The second leg portion includes a second circumferential seal attaching the second leg portion to the second boot and a second leg extension extending from the second circumferential seal to a second terminal end of the second leg portion.

Another example wader comprises a body having a chest portion, a lower portion including first and second leg portions, a first boot attached to the first leg portion and a second boot attached to the second leg portion, the body having an outer surface, an inner surface, and defining an inner chamber sized and configured to receive the legs and torso of a wearer of said wader; the chest portion having first, second, third, and fourth outer pockets, each of the first, second, third, and fourth outer pockets having opening on the outer surface, each of the first and fourth outer pockets having an opening placed on a side of said wader, each of the second and third outer pockets having an opening placed near a midline of said wader; and the chest portion having first and second interior pockets disposed on the inner surface, each of the first and second interior pockets having an opening on an upper side of the pocket, the first interior pocket disposed adjacent the first outer pocket and inward of the first and second outer pockets, and the second interior pocket disposed adjacent the fourth outer pocket and inward of the third and fourth outer pockets. The first leg portion includes a first circumferential seal attaching the first leg portion to the first boot and a first leg extension extending from the first circumferential seal to a first terminal end of the first leg portion. The second leg portion includes a second circumferential seal attaching the second leg portion to the second boot and a second leg extension extending from the second circumferential seal to a second terminal end of the second leg portion. The first leg extension includes a mesh panel extending from the first circumferential seal to the first terminal end.

Another example wader comprises a body having a chest portion, a lower portion including first and second leg portions, a first boot attached to the first leg portion and a second boot attached to the second leg portion, the body having an outer surface, an inner surface, and defining an inner chamber sized and configured to receive the legs and torso of a wearer of said wader; the chest portion having first, second, third, and fourth outer pockets, each of the first, second, third, and fourth outer pockets having opening on the outer surface, each of the first and fourth outer pockets having an opening placed on a side of said wader, each of the second and third outer pockets having an opening placed near a midline of said wader; and the chest portion having first and second interior pockets disposed on the inner surface, each of the first and second interior pockets having an opening on an upper side of the pocket, the first interior pocket disposed adjacent the first outer pocket and inward of the first and second outer pockets, and the second interior pocket disposed adjacent the fourth outer pocket and inward of the third and fourth outer pockets. The first leg portion includes a first circumferential seal attaching the first leg portion to the first boot and a first leg extension extending from the first circumferential seal to a first terminal end of the first leg portion. The second leg portion includes a second circumferential seal attaching the second leg portion to the second boot and a second leg extension extending from the second circumferential seal to a second terminal end of the second leg portion. The first leg extension includes a mesh panel extending from the first circumferential seal to the first terminal end. The second leg extension includes a second mesh panel extending from the second circumferential seal to the second terminal end.

Another example wader comprises a body having a chest portion, a lower portion including first and second leg portions, a first boot attached to the first leg portion and a second boot attached to the second leg portion, the body having an outer surface, an inner surface, and defining an inner chamber sized and configured to receive the legs and torso of a wearer of said wader; the chest portion having first, second, third, and fourth outer pockets, each of the first, second, third, and fourth outer pockets having opening on the outer surface, each of the first and fourth outer pockets having an opening placed on a side of said wader, each of the second and third outer pockets having an opening placed near a midline of said wader; and the chest portion having first and second interior pockets disposed on the inner surface, each of the first and second interior pockets having an opening on an upper side of the pocket, the first interior pocket disposed adjacent the first outer pocket and inward of the first and second outer pockets, and the second interior pocket disposed adjacent the fourth outer pocket and inward of the third and fourth outer pockets. The first interior pocket has a first depth and the second outer pocket has a second depth. The first depth is less than the second depth. The second interior pocket has a third depth and the fourth outer pocket has a fourth depth. The third depth is less than the fourth depth. The first leg portion includes a first circumferential seal attaching the first leg portion to the first boot and a first leg extension extending from the first circumferential seal to a first terminal end of the first leg portion. The second leg portion includes a second circumferential seal attaching the second leg portion to the second boot and a second leg extension extending from the second circumferential seal to a second terminal end of the second leg portion. The first leg extension includes a mesh panel extending from the first circumferential seal to the first terminal end. The second leg extension includes a second mesh panel extending from the second circumferential seal to the second terminal end.

Additional understanding of the inventive waders can be obtained by review of the detailed description of selected examples, below, and the appended drawings.

DETAILED DESCRIPTION OF SELECTED EXAMPLES

Figure 1:
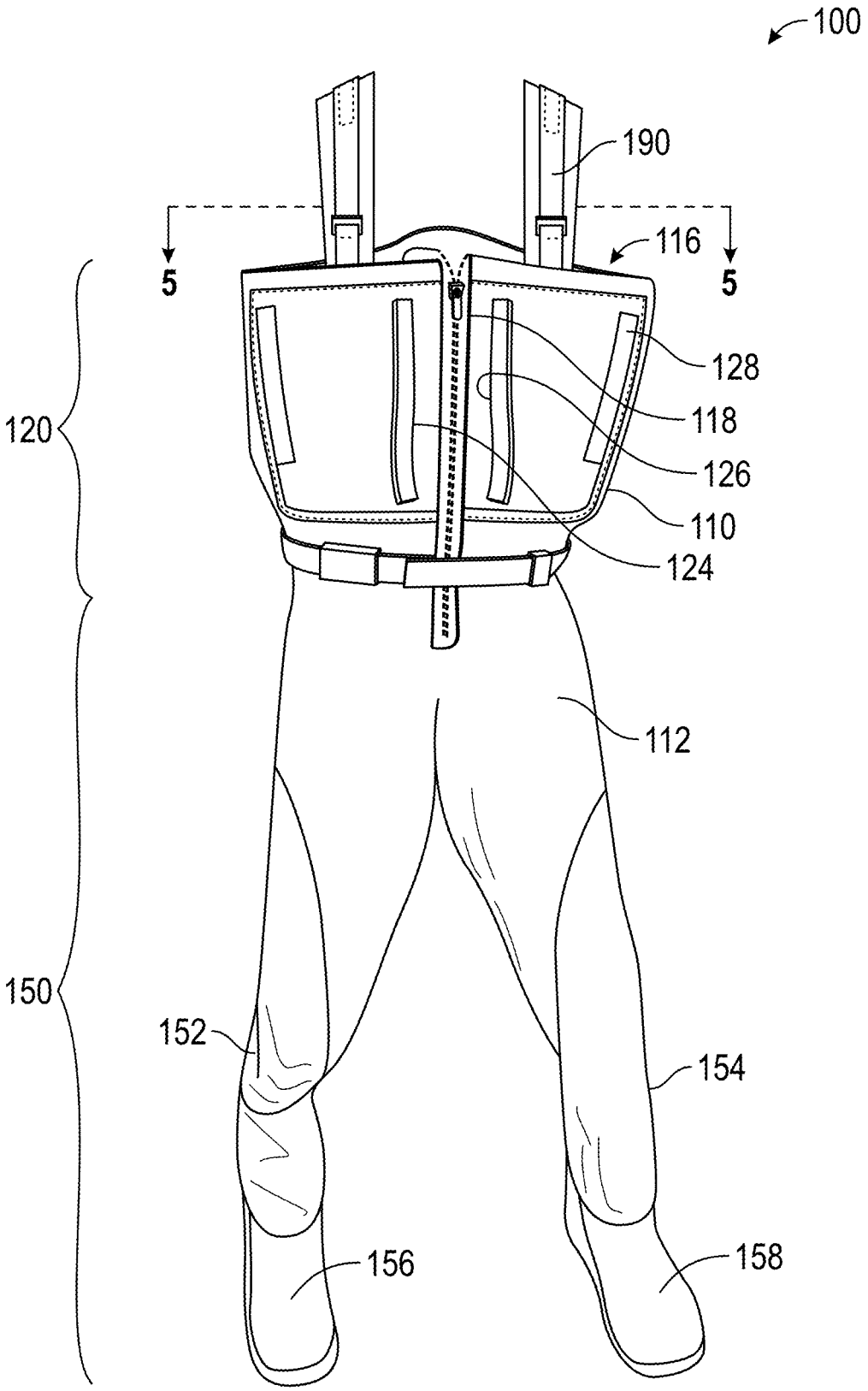
FIG. 1 is a front view of an example wader.

The following detailed description and the appended drawings describe and illustrate various example waders. The description and illustration of these examples are provided to enable one skilled in the art to make and use an example wader in accordance with the invention. They are not intended to limit the scope of the claims in any manner.

FIGS. 1 through 8 illustrate an example wader 100 or a portion thereof. The wader 100 includes a body 110 and attached suspenders 190. The body 110 is a unitary member having a chest portion 120, a lower portion 150 including first 152 and second 154 leg portions and attached first 156 and second 158 boots. The body 110 has an outer surface 112 that is waterproof or water-resistant, an inner surface 114, and defines an inner chamber 116 into which a wearer inserts his or her legs and torso. The suspenders 190 extend over the shoulders of a wearer in use, securing the wader 100 to the wearer's body.

Figure 2:
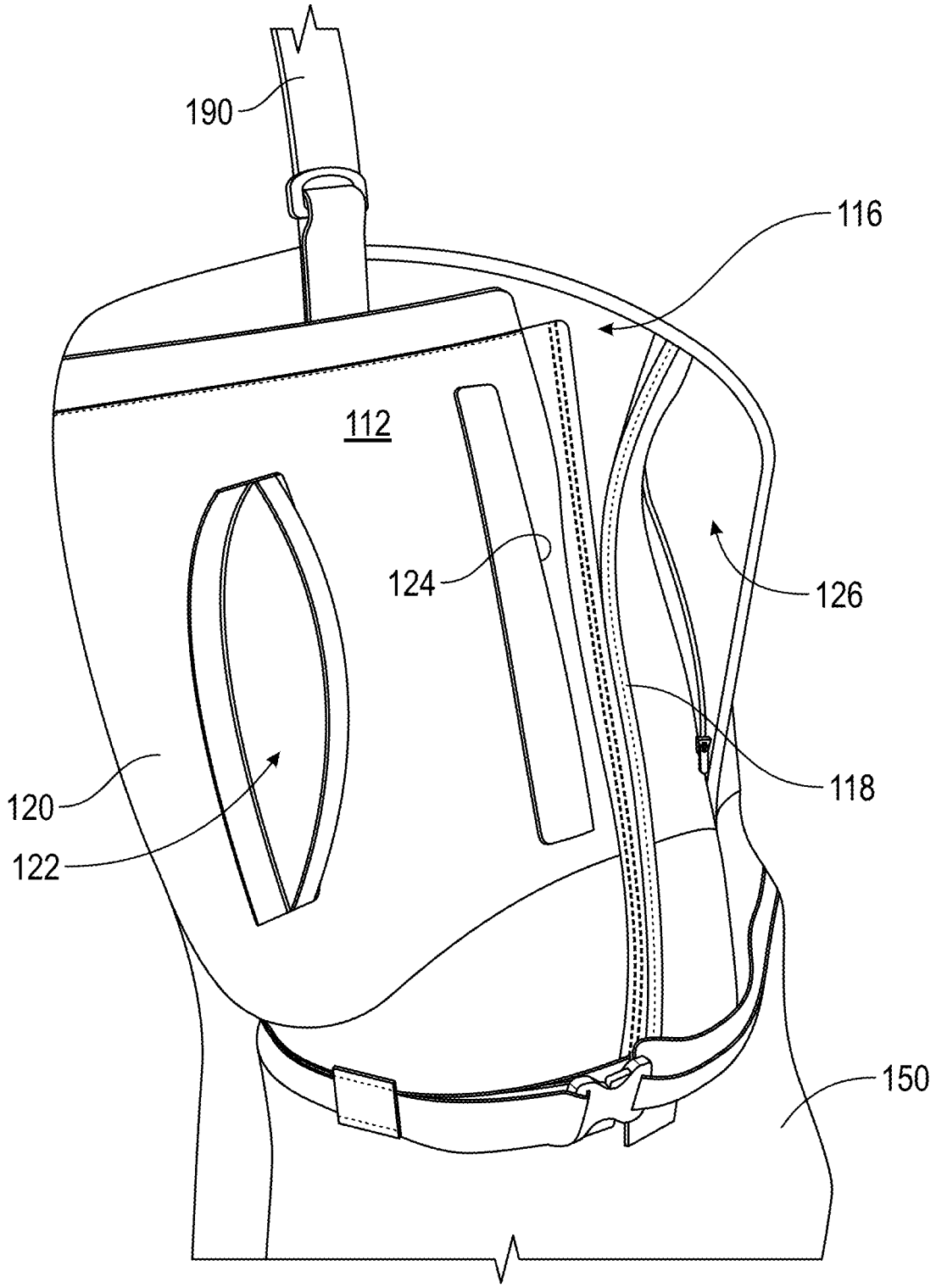
FIG. 2 is a partial side view of the example wader illustrated in FIG. 1.

As best illustrated in FIG. 1, chest portion 120 includes first 122, second 124, third 126, and fourth 128 outer pockets, each of which is accessible through an opening on the outer surface 112. The first 122 and fourth 128 outer pockets are lateral pockets, each having an opening placed on a side of the wader 100 and that opens to the same side of the wader 100. For example, as best illustrated in FIG. 2, the first outer pocket 122 is disposed on the right side of the wader 100, relative to a wearer of the wader 100, and opens to the right side of the wader 100, again relative to the wearer of the wader 100. Similarly, the fourth outer pocket 128 is disposed on the left side of the wader 100 relative to a wearer of the wader 100, and opens to the left side of the wader 100, again relative to the wearer of the wader 100. In contrast, the second 124 and third 126 outer pockets are midline pockets, each having an opening placed near the midline of the wader 100, adjacent a midline zipper 118 for example, and that opens to the opposite side of the wader 100. For example, as best illustrated in FIG. 2, the third outer pocket 126 is disposed on the left side of the wader 100, relative to a wearer of the wader 100, and opens to the right side of the wader 100, again relative to the wearer of the wader 100. Similarly, the second outer pocket 124 is disposed on the right side of the wader 100 relative to a wearer of the wader 100, and opens to the left side of the wader 100, again relative to the wearer of the wader 100. Each of the first 122, second 124, third 126, and fourth 128 outer pockets is a zippered pocket with a zipper that zips upward, toward the suspenders 190, to close the opening to the respective outer pocket 122, 124, 126, 128.

This structural arrangement of the first 122, second 124, third 126, and fourth 128 pockets of the chest portion 128 of the wader provides a distinct advantage in the field as it facilitates quick and easy movement of a hand of between two pockets. As can be readily understood from FIG. 2, for example, a wearer of the wader 100 can quickly remove his or her right hand from the first pocket 122, move his or her forearm across the midline zipper 118, and insert the same hand in the third pocket 126 with a simple, quick, and efficient out, in motion. The same is true for a wearer's left hand, moving it from the fourth pocket 128, across the midline zipper 118, and into the second pocket 124. This quick and easy movement, facilitated by the structure of the wader 100, can increase the ability of a wearer to use a smartphone, for example, during an adventure, extending the utility of the wader 100 beyond the mere provision of protection from the wet environment to supporting new aspects of the sport.

Figure 3:
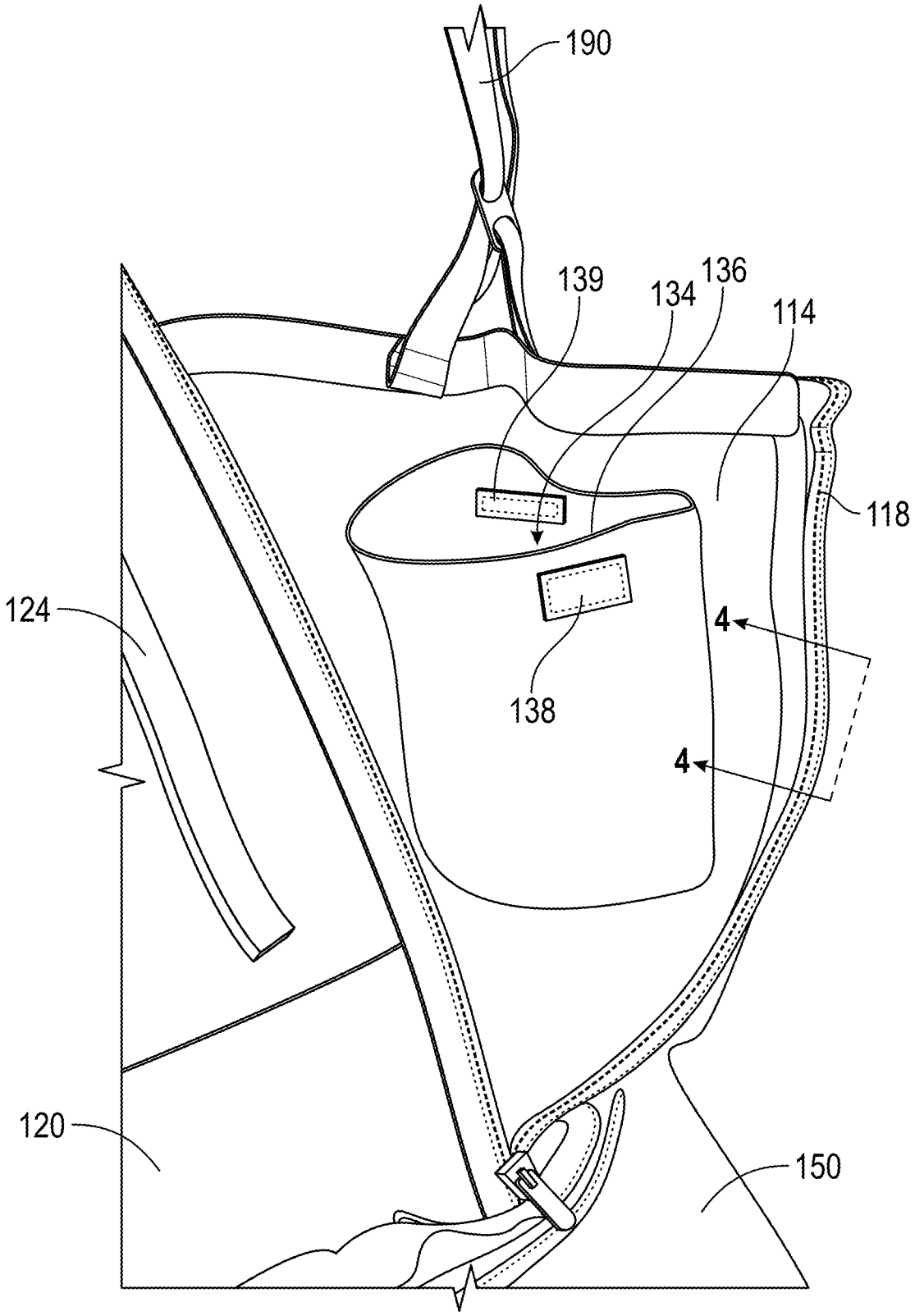
FIG. 3 is a partial side view of the example wader illustrated in FIG. 1. One chest flap is opened to show one inside chest pocket.
Figure 4:
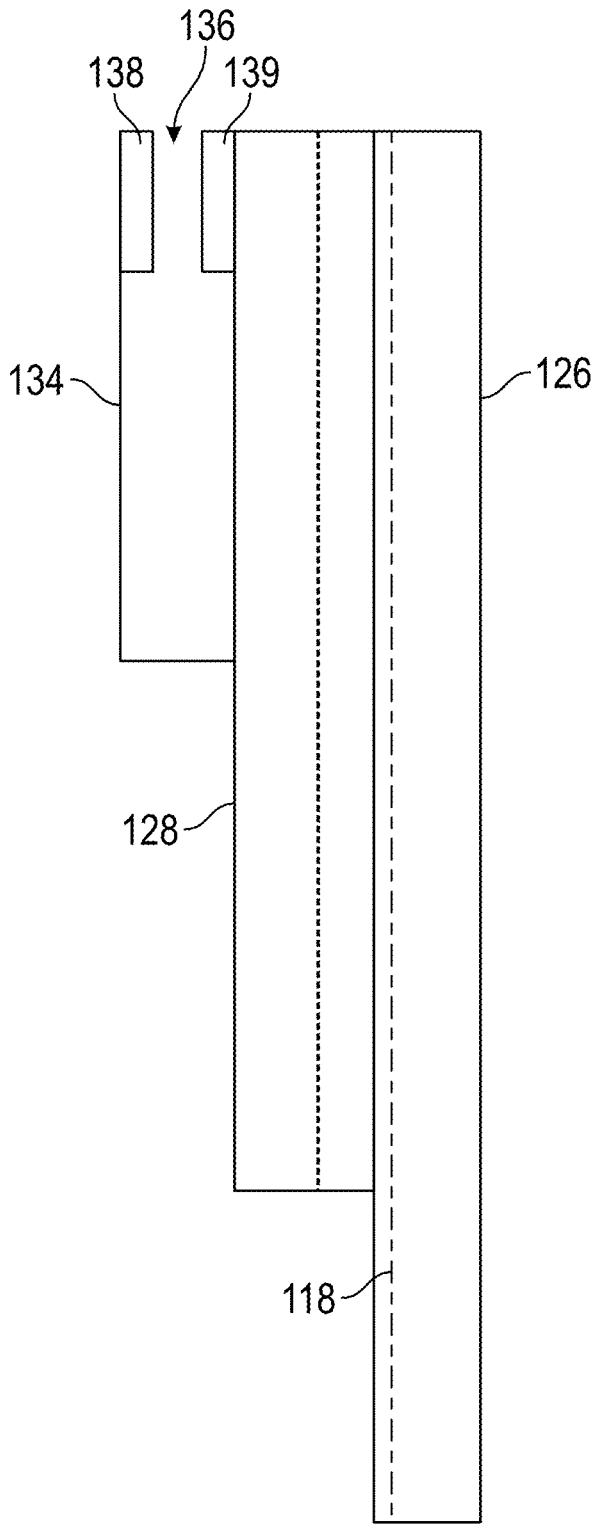
FIG. 4 is a partial sectional view of the example wader illustrated in FIG. 1, taken along line 4-4 in FIG. 3.
Figure 5:
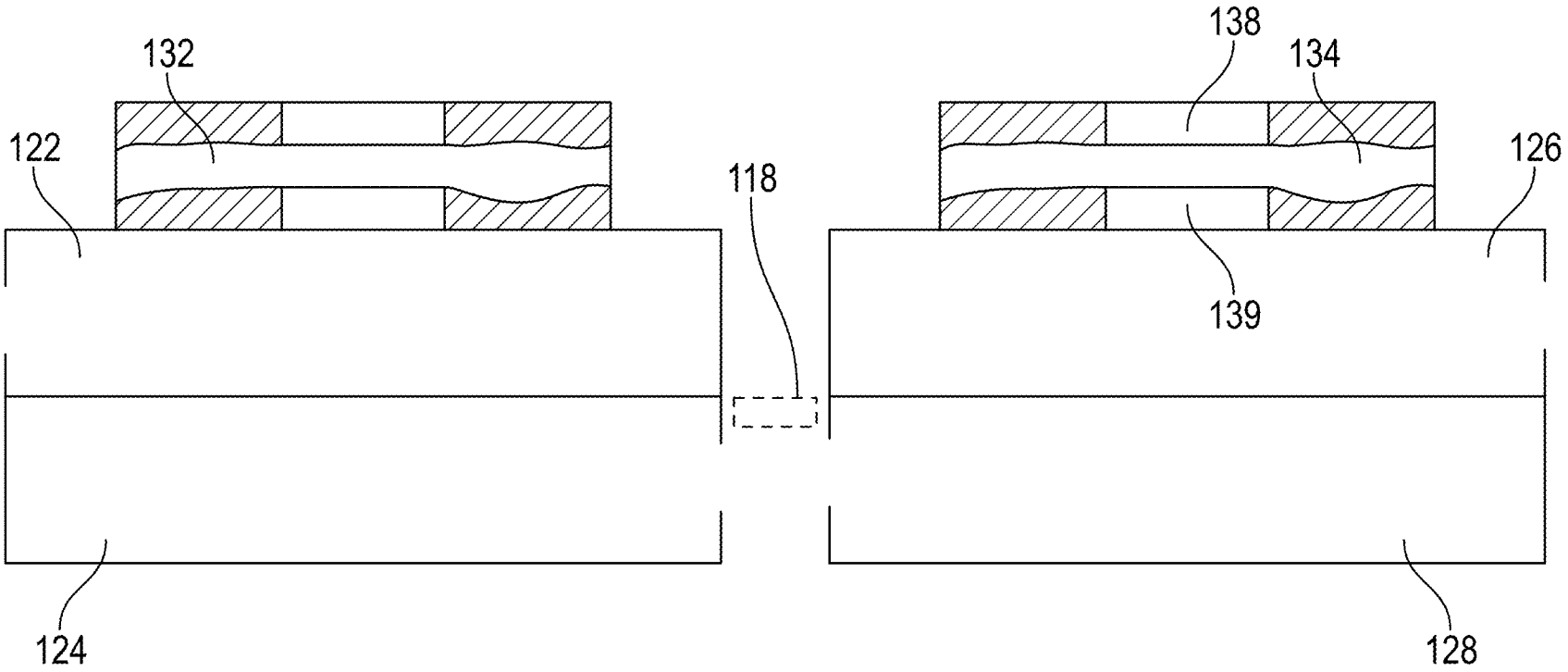
FIG. 5 is a partial sectional view of the example wader illustrated in FIG. 1, taken along line 5-5 in FIG. 1.

Other structural aspects of the wader 100 supplement these aspects and benefits of the inventive waders. For example, as best illustrated in FIGS. 3, 4, and 5, chest portion 120 also includes first 132 and second 134 interior pockets, each of which is disposed on the inner surface 114 and, when worn, adjacent the chest of a wearer. Each of the first 132 and second 134 chest pockets include an opening on the top of the pocket, opening to the top of the wader 100. For example, as best illustrated in FIG. 3, second interior pocket 134 is disposed on the left side of the chest portion 120 of the wader 100, relative to a wearer, and has an opening 136 on its top side. Magnets 138, 139 are enclosed in the material of the opposing flaps of the opening 136 of the top side, providing a magnetic closure for the opening 136. The first interior pocket 132 is disposed on the right side of the chest portion 120 of the wader 100, relative to a wearer, and has a similar structural configuration.

This structural configuration and positioning of the first 132 and second 134 interior pockets provides multiple advantages. For example, a wearer can readily pass an object through the magnetic closure of the opening by simply pushing the object downward with enough force to temporarily interrupt the attraction of the magnets, allowing it to reclose once the object has passed into the depth of the chamber of the pocket.

Also, each of the interior pockets 132, 134, is disposed directly inward of the back panel of a lateral pocket 122, 128, allowing a hand disposed in one of the lateral pockets 122, 128 to grasp an object disposed on the adjacent interior pocket 132, 134. For example, the first interior pocket 132 is disposed directly inward of the first outer pocket 122, and the second interior pocket 134 is disposed directly inward of the fourth outer pocket 128. With this structural configuration, a wearer can dispose a warming packet, for example, in each of the interior pockets 132, 134 and achieve warming of the chest, which is adjacent the interior pockets 132, 134 and of the hands, which can be placed in the first 122 and fourth 128 outer pockets. So placed, the warming packet will warm the hands. When an extra burst of warmth is desired, the wearer can grasp the warming packet in an interior pocket 132, 134 with a hand in an adjacent outer pocket 122, 128 through the fabric panel separating the adjacent pockets.

Lastly, the interior pockets 132, 134 are the shortest, or shallowest, of the interior and outer pockets. The midline pockets 124, 126 are the longest, or deepest, of the interior and outer pockets. This relative structural configuration is advantageous because it ensures an object, such as a smartphone, disposed in one of the midline pockets 124, 126 will be positioned at a distance from the magnets of the openings of the interior pockets 132, 134, reducing the possibility of damage to components of objects disposed in the midline pockets 124, 126 that are sensitive to magnetic fields, such as computer memory, storage mediums, and other magnet sensitive components. This difference of depths of the interior pockets 132, 134 and the midline pockets 124, 126 also reduces overall bulk that occurs with layering of objects placed in the various pockets. By allowing an object placed in a midline pocket 124, 126 to lay relatively lower than an object placed in an interior pocket 132, 134 on the same side of the wader 100, stacking of the objects can be avoided, reducing bulk in the chest area of the wearer and associated interference with arm movement and other activities.

Figure 6:
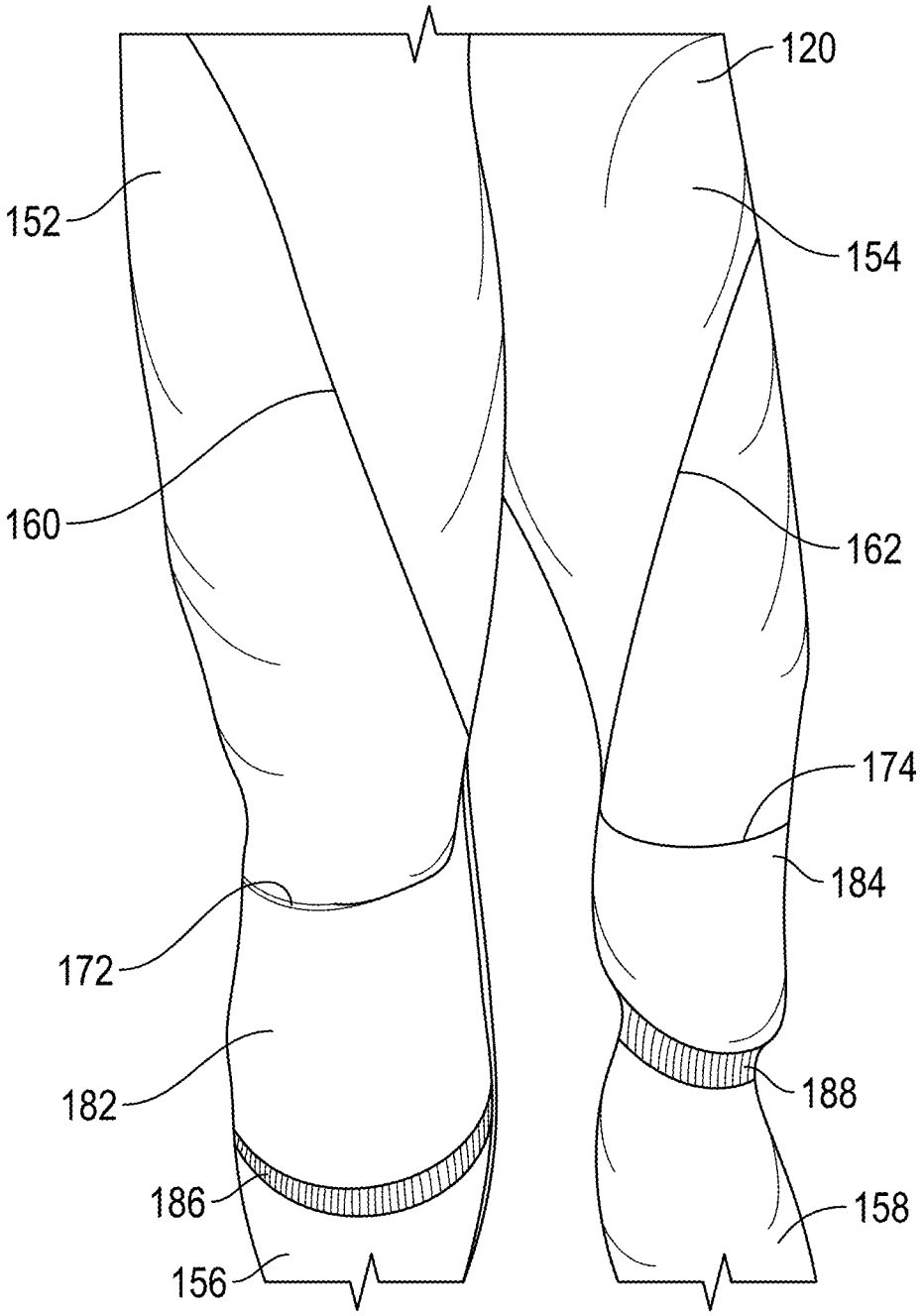
FIG. 6 is a partial front view of the example wader illustrated in FIG. 1. The lower and upper leg portions are illustrated.

Lower portion 150 of wader 100 includes first 152 and second 154 leg portions and attached first 156 and second 158 boots. As a unitary member, wader 100 includes seams 160, 162 joining sections of the same material. As best illustrated in FIGS. 1 and 6, seams 160, 162 advantageously extend across the leg portions 152, 154. Each seam 160, 162 extends from an outer side of the lower portion 150, across a respective one of the leg portions 152, 154, to an inner side of the respective leg portion 152, 154 at a point on an interface between the respective leg portion 152, 154 and its attached boot 156, 158. This positioning of the seams 160, 162 minimizes the extent to which the seams 160, 162 extend along the inside of the leg portions 152, 154, which are areas of high friction during use of the wader 100. Positioned in this manner, seams 160, 162 are not subject to the greatest source of wear on the material of the wader 100, friction between leg portions 152, 154 during use, which is expected to extend the usable life of the wader 100.

Each leg portion 152, 154 has a circumferential seal with an attached boot 156, 158. Thus, leg portion 152 has circumferential seal 172 that attaches the leg portion 152 to boot 156. Similarly, leg portion 154 has a circumferential seal 174 attaches the leg portion 154 to boot 158. Each of the circumferential seals 172, 174 is positioned axially within the length of the respective leg portion 152, 154, creating a leg extension 182, 184 for each leg portion that extends from the respective circumferential seal 172, 174 to the terminal end 186, 188 of the respective leg portion 152, 154, which advantageously includes an elastic band to gather the terminal end 186, 188 around the body of the respective boot 156, 158.

Figure 7:
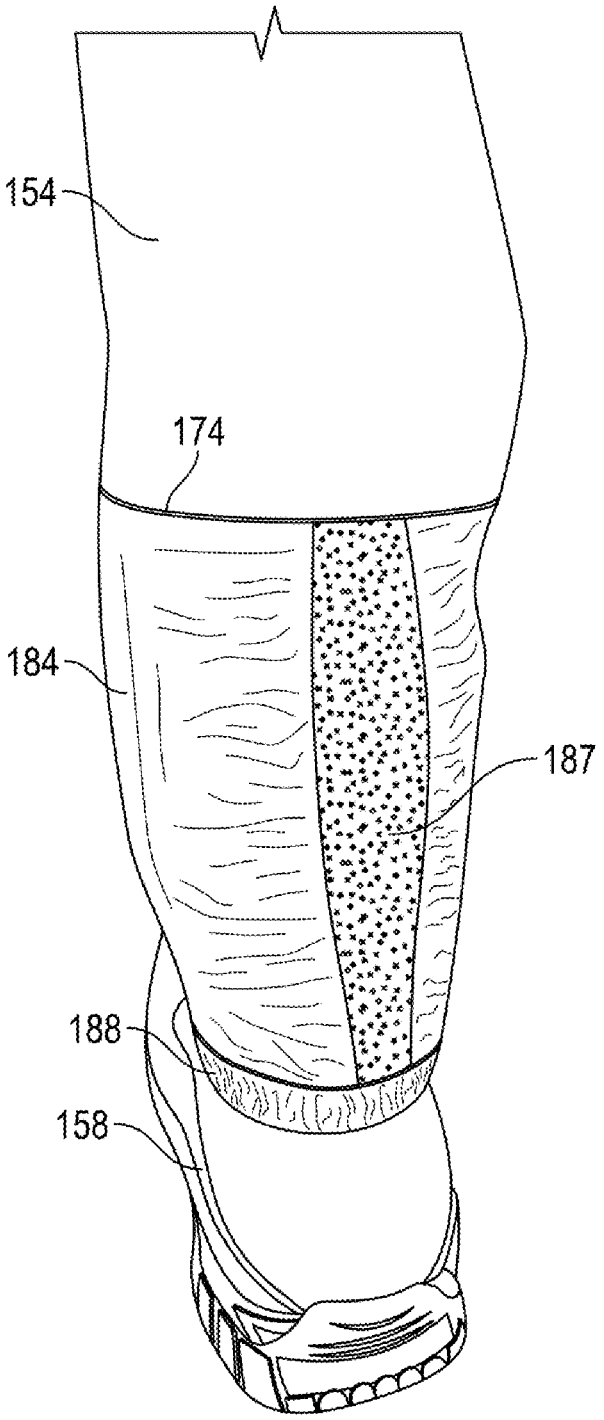
FIG. 7 is a partial rear view of the example wader illustrated in FIG. 1. The boot and lower leg portion of the example wader are illustrated with the leg extension in an extended position.
Figure 8:
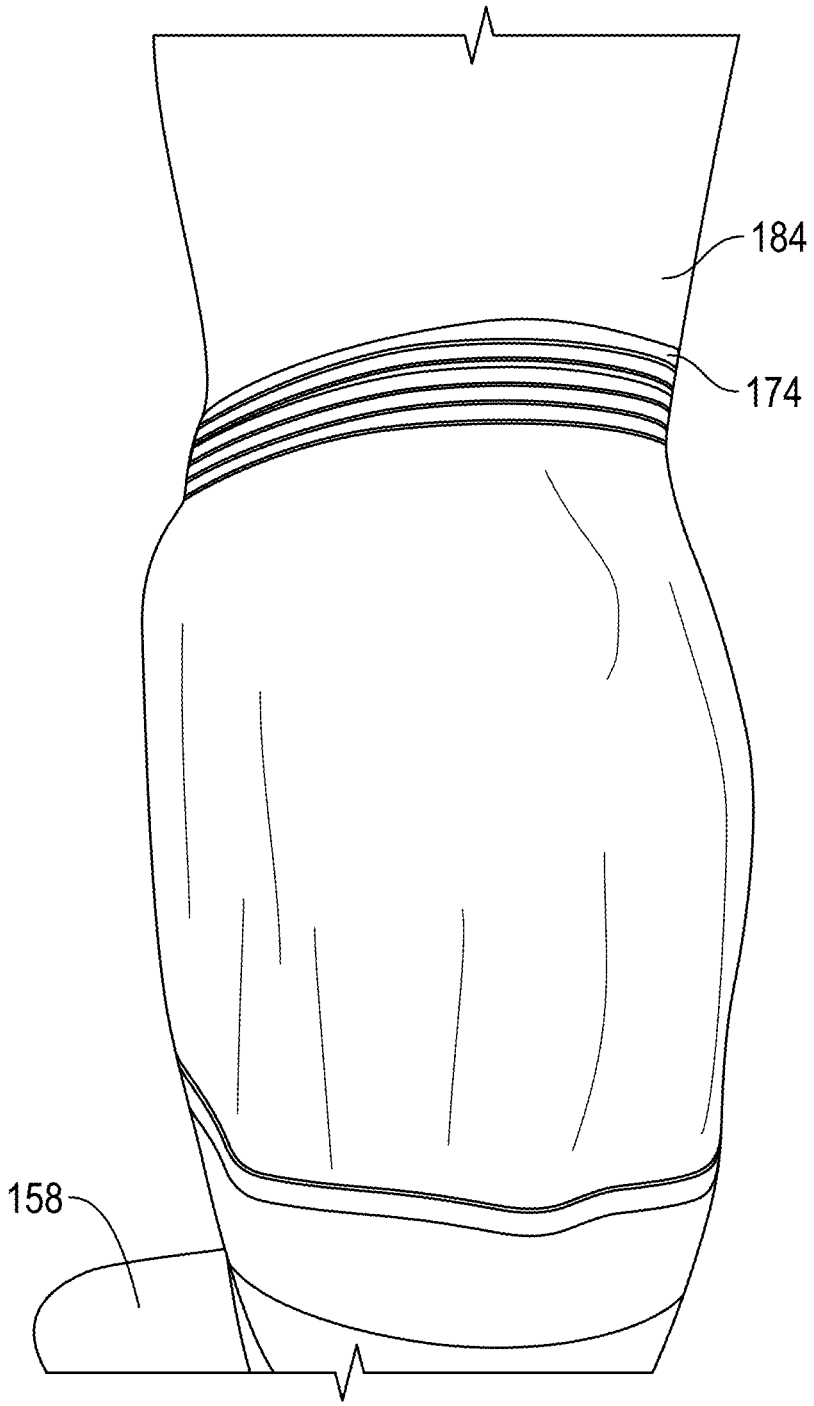
FIG. 8 is a partial side view of the example wader illustrated in FIG. 1. The boot and lower leg portion of the example wader are illustrated with the leg extension in an inverted position.

Each leg extension 182, 184 includes a mesh panel 187 that extends from the respective circumferential seal 172, 174 to the terminal end 186, 188. For example, as best illustrated in FIG. 7, mesh panel 187 extends from circumferential seal 174 to terminal end 188. Each mesh panel 187 provides access to the interior of the respective leg extension 182, 184, allowing water and other fluids to flow from inside the leg extension 182, 184 to the exterior. This structural configuration provides an always on drainage function to the wader 100, efficiently eliminating water that becomes trapped in the leg extensions 182, 184, which can occur when walking through watery environments. Debris may become trapped in the leg extensions 182, 184, which may block the mesh panels [185,] 187 and impede this drainage function. The relative structural arrangement of the circumferential seals 172, 174, mesh panels 187, and terminal ends 186, 188 of the leg extensions 182, 184 provides a distinct advantage in this situation. As best illustrated in FIG. 8, an inversion of a leg extension 184, moving the terminal end 188 from around the boot 158 upward and away from the boot 158, quickly exposes the interior of the leg extension 184, flushing all trapped water and debris out of the leg extension 184. Once empty, a wearer can simply grab the terminal end 188 and move it downward, quickly returning the leg extension 184 back to its position around the boot 158 and returning to the adventure. Thus, the structural configuration of the circumferential seals 172, 174, leg extensions 182, 184, mesh panels 187, and terminal ends 186, 188 provides the distinct advantage of enabling always on drainage and rapid flush drainage modes, each of which functions without requiring the wearer to remove the wader 100 or a boot.

All components of waders according to embodiments of the invention can be made of any suitable material, including materials conventionally used in waders and other adventure gear. Examples of suitable materials include, but are not limited to nylon, rubber, polymeric materials, and the like. Materials should have suitable levels of water resistance and breathability. Four layer nylon is considered to be an advantageous material for the body 110; neoprene is considered to be an advantageous material for the boots 156, 158. Imagery, such as camouflage imagery, can be included to enhance appearance and/or utility. Seams between sections of the same or similar material, such as seams 160, 162 on leg portions 152, 154, advantageously comprise welded seams, omitting use of adhesives and stitching.

Waders according to the invention are useful in a variety of adventures and environments, including hunting, fishing, and other outdoor activities in which an individual may adventure into water and wish to remain dry.

Those with ordinary skill in the art will appreciate that various modifications and alternatives for the described and illustrated example embodiments can be developed in light of the overall teachings of the disclosure. Accordingly, the particular arrangements disclosed are intended to be illustrative only and not limiting as to the scope of the invention, which is to be given the full breadth of the appended claims and any and all equivalents thereof.

What is claimed is:

1. A wader, comprising:

a body having a chest portion, a lower portion including first and second leg portions, a first boot attached to the first leg portion and a second boot attached to the second leg portion, the body having an outer surface, an inner surface, and defining an inner chamber sized and configured to receive the legs and torso of a wearer of the wader;

the chest portion having first, second, third, and fourth outer pockets, each of the first, second, third, and fourth outer pockets having opening on the outer surface, each of the first and fourth outer pockets having an opening placed on a side of the wader, each of the second and third outer pockets having an opening placed near a midline of the wader; and the chest portion having first and second interior pockets disposed on the inner surface, each of the first and second interior pockets having an opening on an upper side of the pocket, the first interior pocket disposed adjacent the first outer pocket and inward of the first and second outer pockets, and the second interior pocket disposed adjacent the fourth outer pocket and inward of the third and fourth outer pockets wherein the first leg portion includes a first circumferential seal attaching the first leg portion to the first boot and a first leg extension extending from the first circumferential seal to a first terminal end of the first leg portion;

wherein the second leg portion includes a second circumferential seal attaching the second leg portion to the second boot and a second leg extension extending from the second circumferential seal to a second terminal end of the second leg portion;

wherein the first leg extension includes a mesh panel extending from the first circumferential seal to the first terminal end; and wherein the second leg extension includes a second mesh panel extending from the second circumferential seal to the second terminal end.

2. The wader of claim 1, wherein the first interior pocket has a first depth and the second outer pocket has a second depth;

wherein the first depth is less than the second depth.

3. The wader of claim 2, wherein the second interior pocket has a third depth and the fourth outer pocket has a fourth depth;

wherein the third depth is less than the fourth depth.

4. The wader of claim 3, wherein the first interior pocket includes first and second magnets configured to close the opening of the first interior pocket.

5. The wader of claim 4, wherein the second interior pocket includes third and fourth magnets configured to close the opening of the second interior pocket.

6. The wader of claim 1, further comprising suspenders attached to the body.

7. The wader of claim 1, further comprising a zipper extending along a midline of the body.

8. The wader of claim 7, wherein the zipper defines first and second side portions of the chest portion; and wherein the first and second outer pockets are on the first side portion and the third and fourth outer pockets are on the second side portion.

9. The wader of claim 8, wherein the openings of the first and second outer pockets are oriented in opposite directions relative to the zipper.

10. The wader of claim 9, wherein the opening of the first outer pocket extends into the first outer pocket toward the zipper.

11. The wader of claim 10, wherein the opening of the second outer pocket extends into the second outer pocket away from the zipper.

12. The wader of claim 11, wherein the openings of the third and fourth outer pockets are oriented in opposite directions relative to the zipper.

13. The wader of claim 12, wherein the opening of the third outer pocket extends into the first outer pocket away the zipper.

14. The wader of claim 13, wherein the opening of the fourth outer pocket extends into the second outer pocket toward from the zipper.

15. A wader, comprising:

a body having a chest portion, a lower portion including first and second leg portions, a first boot attached to the first leg portion and a second boot attached to the second leg portion, the body having an outer surface, an inner surface, and defining an inner chamber sized and configured to receive the legs and torso of a wearer of the wader;

the chest portion having a zipper extending along a midline of the body and defining first and second side portions of the chest portion, first and second outer pockets on the first side portion and third and fourth outer pockets on the second portion, each of the first and fourth outer pockets having an opening placed on a side of the wader and extending into the respective pocket and toward the zipper, each of the second and third outer pockets having an opening placed near the midline of the wader and extending into the respective pocket and away from the zipper;

the chest portion having first and second interior pockets disposed on the inner surface, each of the first and second interior pockets having an opening on an upper side of the pocket, the first interior pocket disposed adjacent the first outer pocket and inward of the first and second outer pockets, and the second interior pocket disposed adjacent the fourth outer pocket and inward of the third and fourth outer pockets;

wherein the first interior pocket has a first depth and the second outer pocket has a second depth;

wherein the first depth is less than the second depth;

wherein the second interior pocket has a third depth and the fourth outer pocket has a fourth depth;

wherein the third depth is less than the fourth depth;

wherein the first leg portion includes a first circumferential seal attaching the first leg portion to the first boot and a first leg extension extending from the first circumferential seal to a first terminal end of the first leg portion;

wherein the second leg portion includes a second circumferential seal attaching the second leg portion to the second boot and a second leg extension extending from the second circumferential seal to a second terminal end of the second leg portion;

wherein the first leg extension includes a mesh panel extending from the first circumferential seal to the first terminal end; and wherein the second leg extension includes a second mesh panel extending from the second circumferential seal to the second terminal end.

* * * * *